US010961746B2

(12) United States Patent
Hood

(10) Patent No.: US 10,961,746 B2
(45) Date of Patent: Mar. 30, 2021

(54) MORTISE LOCK AND MORTISE LOCK SYSTEMS AND METHODS

(71) Applicant: dormakaba USA Inc., Reamstown, PA (US)

(72) Inventor: Brian H. Hood, Zionsville, IN (US)

(73) Assignee: dormakaba USA Inc., Reamstown, PA (US)

( * ) Notice: Subject to any disclaimer, the term of this patent is extended or adjusted under 35 U.S.C. 154(b) by 0 days.

(21) Appl. No.: 16/136,979

(22) Filed: Sep. 20, 2018

(65) Prior Publication Data

US 2020/0095805 A1 Mar. 26, 2020

(51) Int. Cl.

| | |
|---|---|
| ***E05B 47/06*** | (2006.01) |
| ***G07C 9/00*** | (2020.01) |
| ***E05B 59/00*** | (2006.01) |
| ***E05B 47/00*** | (2006.01) |
| *E05B 47/02* | (2006.01) |

(52) U.S. Cl.

CPC ..... *E05B 47/0673* (2013.01); *E05B 47/0004* (2013.01); *G07C 9/00571* (2013.01); *E05B 47/026* (2013.01); *E05B 59/00* (2013.01); *E05B 2047/0085* (2013.01); *G07C 9/00817* (2013.01); *G07C 2009/00825* (2013.01)

(58) Field of Classification Search

CPC ..... E05B 47/0673; E05B 47/0004; E05B 47/026; E05B 59/00; E05B 47/0012; E05B 2047/0085; E05B 2047/0021; G07C 9/00571; G07C 9/00817; G07C 2009/00825; G07C 2209/62

USPC ... 70/277, 278.7, 279.1, 283, 467, 468, 470, 70/483–486, 150, 152, 210; 292/169.14–169.18, 169.21–169.23, 144

See application file for complete search history.

(56) References Cited

U.S. PATENT DOCUMENTS

| | | | | |
|---|---|---|---|---|
| 1,833,572 A * | 11/1931 | Hardesty | E05B 77/48 70/262 |
| 2,086,982 A * | 7/1937 | McCarter | E05B 55/00 70/484 |
| 2,729,089 A * | 1/1956 | Pelcin | E05B 47/0002 70/151 R |
| 3,985,008 A | 10/1976 | Hart | |
| 4,685,709 A | 8/1987 | Kambic | |

(Continued)

FOREIGN PATENT DOCUMENTS

| | | |
|---|---|---|
| WO | 1996001355 | 1/1996 |
| WO | 1998002630 | 1/1998 |

(Continued)

OTHER PUBLICATIONS

Schlage "CO-220 Standalone classroom lockdown solution with remote fob and visual indicator," Allegion, 009575, Rev. Aug. 2017. www.allegion.com/us, 4 pages.

(Continued)

*Primary Examiner* — Lloyd A Gall

(74) *Attorney, Agent, or Firm* — Faegre Drinker Biddle & Reath LLP

(57) ABSTRACT

A mortise lock system may include a plurality of hub lock actuators which may be independently actuatable to inhibit a retraction of a latch bolt of the mortise lock system. One of the plurality of hub lock actuators may be electrically driven and responsive to a lockdown command received from a remote device.

18 Claims, 15 Drawing Sheets

(56) References Cited

U.S. PATENT DOCUMENTS

| | | | | |
|---|---|---|---|---|
| 5,473,236 | A | 12/1995 | Frolov | |
| 5,487,289 | A * | 1/1996 | Otto, III | E05B 47/0002 292/150 |
| 5,608,298 | A | 3/1997 | Frolov et al. | |
| 5,678,870 | A | 10/1997 | Pelletier | |
| 5,782,118 | A | 7/1998 | Chamberlain et al. | |
| 5,931,430 | A | 8/1999 | Palmer | |
| 6,038,896 | A | 3/2000 | Chamberlain et al. | |
| 6,053,019 | A * | 4/2000 | Wiik | E05B 47/0673 70/283 |
| 6,145,353 | A | 11/2000 | Doucet | |
| 6,354,121 | B1 | 3/2002 | Frolov | |
| 6,419,286 | B1 | 7/2002 | Szablewski | |
| 6,487,884 | B1 | 12/2002 | Constantinou | |
| 6,899,361 | B2 | 5/2005 | Dorn | |
| 7,007,526 | B2 | 3/2006 | Frolov et al. | |
| 7,051,561 | B2 | 5/2006 | Moon et al. | |
| 7,089,770 | B2 | 8/2006 | Ramsauer et al. | |
| 7,165,428 | B2 | 1/2007 | Isaacs et al. | |
| 7,188,495 | B2 * | 3/2007 | Errani | E05B 47/0692 70/218 |
| 7,497,486 | B1 | 3/2009 | Davis et al. | |
| 7,501,930 | B2 | 3/2009 | Cote et al. | |
| 7,698,919 | B2 | 4/2010 | Kim | |
| 7,757,524 | B2 | 7/2010 | Frolov et al. | |
| 7,784,315 | B2 * | 8/2010 | Yang | E05C 9/026 292/DIG. 32 |
| 7,870,770 | B2 | 1/2011 | Blanch | |
| 7,918,117 | B2 | 4/2011 | Frolov et al. | |
| 8,292,336 | B2 | 10/2012 | Moon | |
| 8,419,087 | B2 | 4/2013 | Shen | |
| 8,424,935 | B2 | 4/2013 | Moon | |
| 8,616,031 | B2 | 12/2013 | Ullrich et al. | |
| 8,844,330 | B2 | 9/2014 | Moon et al. | |
| 9,260,887 | B2 | 2/2016 | Lambrou et al. | |
| 9,334,676 | B2 | 5/2016 | Lambrou et al. | |
| 9,394,722 | B2 | 7/2016 | Moon et al. | |
| 9,500,007 | B2 | 11/2016 | Lambrou et al. | |
| 9,512,644 | B2 | 12/2016 | Lambrou et al. | |
| 9,551,174 | B2 | 1/2017 | Bartos et al. | |
| 9,663,972 | B2 | 5/2017 | Ullrich et al. | |
| 2005/0284200 | A1 | 12/2005 | Moon et al. | |
| 2006/0000247 | A1 | 1/2006 | Moon et al. | |
| 2006/0001522 | A1 | 1/2006 | Moon et al. | |
| 2007/0209413 | A1 | 9/2007 | Dobbs | |
| 2008/0028806 | A1 | 2/2008 | Fort et al. | |
| 2010/0263418 | A1 | 10/2010 | Moon | |
| 2012/0313383 | A1 | 12/2012 | Lundberg et al. | |
| 2013/0192319 | A1 | 8/2013 | Lambrou et al. | |
| 2013/0298617 | A1 | 11/2013 | Lambrou et al. | |
| 2015/0135781 | A1 | 5/2015 | Kleiner et al. | |
| 2015/0159402 | A1 | 6/2015 | Yahav | |
| 2016/0258189 | A1 | 9/2016 | Frolov | |
| 2017/0051533 | A1 | 2/2017 | Kester et al. | |
| 2017/0175420 | A1 | 6/2017 | Chen | |
| 2018/0073275 | A1 | 3/2018 | Ullrich et al. | |

FOREIGN PATENT DOCUMENTS

| | | |
|---|---|---|
| WO | 1999031340 | 6/1999 |
| WO | 1999064704 | 12/1999 |
| WO | 2001011169 | 2/2001 |
| WO | 2001042594 | 6/2001 |
| WO | 2001077465 | 10/2001 |
| WO | 2001094726 | 12/2001 |
| WO | 2003062571 | 7/2003 |
| WO | 2005073489 | 8/2005 |
| WO | 2006039751 | 4/2006 |
| WO | 2007049261 | 5/2007 |
| WO | 2008073228 | 6/2008 |
| WO | 2009021857 | 2/2009 |
| WO | 2010046677 | 4/2010 |
| WO | 2011103844 | 9/2011 |
| WO | 2011119900 | 9/2011 |
| WO | 2011160628 | 12/2011 |
| WO | 2012006658 | 1/2012 |
| WO | 2012097410 | 7/2012 |
| WO | 2012116037 | 8/2012 |
| WO | 2012119184 | 9/2012 |
| WO | 2012122584 | 9/2012 |
| WO | 2013006889 | 1/2013 |

OTHER PUBLICATIONS

Sargent "7900 Series Mortise Locks," Sargent Manufacturing Company, 90143 Jun. 2018. www.sargentlock.com, 22 pages.

Stanley Security Solutions "40H Series Heavy Duty Mortise Locks," Stanley Security Solutions, BA-0012 Nov. 2014, www.stanleysecuritysolutions.com. 20 pages.

International Search Report in PCT Application No. PCT/US19/51961 dated Mar. 26, 2020 (2 pages).

Written Opinion of the International Searching Authority in PCT Application No. PCT/US19/51961 dated Mar. 26, 2020 (5 pages).

International Search Report and Written Opinion received for PCT Patent Application No. PCT/US2019/051961, dated Dec. 3, 2019, 7 pages.

* cited by examiner

MORTISE LOCK AND MORTISE LOCK SYSTEMS AND METHODS

FIELD

The present disclosure relates to mortise locks and in particular to mortise locks having multiple actuators to lock at least one operator input device against rotation.

BACKGROUND

Mortise locks are known. Known mortise and cylindrical locks can be electronically locked down when a signal is received by a fob or other device.

Conventional split hub mortise locks have a first hub which is rotatable by a first operator input device to cause a retraction of the latch bolt of the mortise lock and a second hub which is rotatable by a second operator input device to cause a retraction of the latch bolt of the mortise lock. Published PCT application No. WO2012/097410 discloses an exemplary split hub mortise lock.

SUMMARY

In embodiments, a mortise lock system may include a plurality of hub lock actuators which may be independently actuatable to inhibit a retraction of a latch bolt of the mortise lock system. One of the plurality of hub lock actuators may be electrically driven and responsive to a lockdown command received from a remote device.

In embodiments, a mortise lock is provided that has a common hub lock which is engageable with one or more hubs to inhibit retraction of a latch bolt of the mortise lock, the common hub lock being actuatable by a plurality of hub lock actuators.

In an exemplary embodiment of the present disclosure, a mortise lock is provided. The mortise lock comprising a mortise housing; a latch bolt movable between an extended position and a retracted position; a first latch hub supported by the mortise housing and operatively coupled to the latch bolt; a second latch hub supported by the mortise housing and operatively coupled to the latch bolt independent of the first latch hub; a hub lock movable between (a) a first position wherein each of the first latch hub and the second latch hub are capable of being rotated to move the latch bolt to the retracted position and (b) a second position wherein only one of the first latch hub and the second latch hub is capable of being rotated to move the latch bolt to the retracted position; a first hub lock actuator supported by the mortise housing; and a second hub lock actuator supported by the mortise housing. Each of the first hub lock actuator and the second hub lock actuator is capable of moving the hub lock from the first position to the second position independent of the other of the first hub lock actuator and the second hub lock actuator.

In embodiments, once the hub lock is in the second position due to an actuation of one of the first hub lock actuator and the second hub lock actuator, a subsequent actuation of the other of the first hub lock actuator and the second hub lock actuator is unable to return the hub lock back to the first position.

In embodiments, the second hub lock actuator is driven in response to an electrical input from an electric controller and the first hub lock actuator is driven in response to a mechanical input. In a variation, the mechanical input is a movement of an operator input accessible from an exterior of the mortise lock. In another variation, the electrical input drives a motor to actuate the first hub lock actuator.

In embodiments, the hub lock comprises a base member; a first locking toggle supported by the base member and including a first engagement feature which is positionable to engage an engagement feature of the first latch hub; and a second locking toggle supported by the base member and including a first engagement feature which is positionable to engage an engagement feature of the second latch hub. The first locking toggle is positionable relative to the base member in a first position and a second position, the first position of the first locking toggle relative to the base member results in the first engagement feature of the first locking toggle engaging the engagement feature of the first latch hub when the hub lock is in the second position and the second position of the first locking toggle relative to the base member results in the engagement feature of the first locking toggle remaining disengaged from the engagement feature of the first latch hub when the hub lock is in the second position. The second locking toggle is positionable relative to the base member in a first position and a second position, the first position of the second locking toggle relative to the base member results in the first engagement feature of the second locking toggle engaging the engagement feature of the second latch hub when the hub lock is in the second position and the second position of the second locking toggle relative to the base member results in the engagement feature of the second locking toggle remaining disengaged from the engagement feature of the second latch hub when the hub lock is in the second position.

In embodiments, the first hub lock actuator includes an engagement feature which interacts with a first engagement feature of the hub lock to move the hub lock from the first position to the second position and the second hub lock actuator includes an engagement feature which interacts with a second engagement feature of the hub lock to move the hub lock from the first position to the second position.

In embodiments, the first hub lock actuator is disengaged from the hub lock when the hub lock is moved to the second position by the second hub lock actuator.

In embodiments, the second hub lock actuator is engaged with the hub lock when the hub lock is moved to the second position by the first hub lock actuator.

In embodiments, the first hub lock actuator includes a cam and a locking lever operatively coupled to the cam, the cam having a first cam position wherein the locking lever is positioned to permit the hub lock to be in the first position of the hub lock and a second cam position wherein the locking lever is positioned to hold the hub lock in the second position of the hub lock.

In embodiments, the second hub lock actuator includes a motor, a gear assembly movable by the motor, and a coupler driven by the gear assembly, the coupler having a first position wherein the hub lock is permitted to be in the first position of the hub lock and the coupler having a second position wherein the hub lock is held in the second position of the hub lock. In a variation thereof, the gear assembly includes a worm gear rotatably mounted to the motor and a sector gear driven by the worm gear.

In another exemplary embodiment of the present disclosure, a mortise lock is provided. The mortise lock comprising a mortise housing; a latch bolt supported by the mortise housing and movable between an extended position and a retracted position; a latch hub supported by the mortise housing and operatively coupled to the latch bolt; and a plurality of hub lock actuators supported by the mortise housing. Each of the plurality of hub lock actuators are actuatable to selectively cause engagement with a common engagement feature of the latch hub to prevent the latch hub from being positionable to move the latch bolt to the retracted position.

In embodiments, a first hub lock actuator of the plurality of hub lock actuators is driven in response to an electrical input from an electric controller and a second hub lock actuator of the plurality of hub lock actuators is driven in response to a mechanical input. In a variation, the first hub lock actuator of the plurality of hub lock actuators is actuatable independent of the second hub lock actuator of the plurality of hub lock actuators. In another variation, when the common engagement feature of the latch hub is engaged due to an actuation of one of the first hub lock actuator of the plurality of hub lock actuators and the second hub lock actuator of the plurality of hub lock actuators, a subsequent actuation of the other of the first hub lock actuator of the plurality of hub lock actuators and the second hub lock actuator of the plurality of hub lock actuators is unable to disengage the common engagement feature of the latch hub to permit retraction of the latch bolt due to a rotation of the latch hub. In a further variation, each of the first hub lock actuator of the plurality of hub lock actuators and the second hub lock actuator of the plurality of hub lock actuators are operatively engageable with a common hub lock, the hub lock being positionable by either of the first hub lock actuator of the plurality of hub lock actuators and the second hub lock actuator of the plurality of hub lock actuators to engage the common engagement feature of the latch hub.

In a further exemplary embodiment of the present disclosure, a method of inhibiting a retraction of a latch bolt of a mortise lock is provided. The method comprising the steps of: receiving an input to a first hub lock actuator to inhibit retraction of the latch bolt of the mortise lock, the first hub lock actuator being one of a plurality of hub lock actuators; and actuating the first hub lock actuator to cause an engagement with a common engagement feature of a retraction assembly of the mortise lock to inhibit retraction of the latch bolt of the mortise lock, each of the plurality of hub lock actuators being capable of causing the engagement of the common engagement feature of the retraction assembly of the mortise lock to inhibit retraction of the latch bolt of the mortise lock.

In embodiments, the method further comprises the steps of: receiving an input to a second hub lock actuator to permit retraction of the latch bolt of the mortise lock; and maintaining the first hub lock actuator in engagement with the common engagement feature of the retraction assembly of the mortise lock to continue to inhibit retraction of the latch bolt of the mortise lock. In a variation, the method further comprises the step of retracting the latch bolt of the mortise lock through a second engagement feature of the retraction assembly of the mortise lock while the first hub lock actuator remains in engagement with the common engagement feature of the retraction assembly.

BRIEF DESCRIPTION OF THE DRAWINGS

The above-mentioned and other features and advantages of this disclosure, and the manner of attaining them, will become more apparent and will be better understood by reference to the following description of exemplary embodiments taken in conjunction with the accompanying drawings, wherein.

Figure 1:
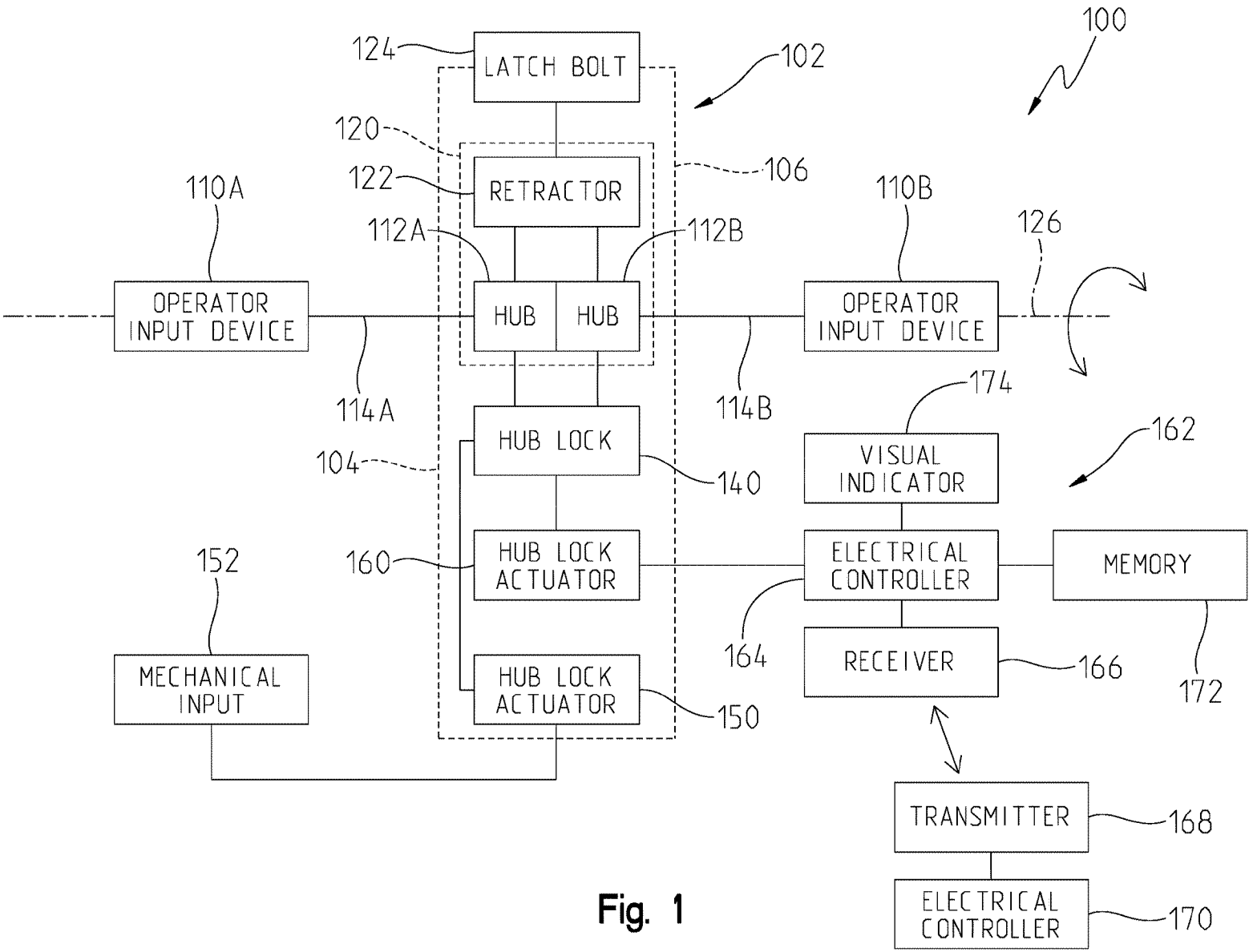
FIG. 1 illustrates a representative view of an exemplary mortise lock system of the present disclosure.

Corresponding reference characters indicate corresponding parts throughout the several views. The exemplifications set out herein illustrate exemplary embodiments of the present disclosure and such exemplifications are not to be construed as limiting the scope of the present disclosure in any manner.

DETAILED DESCRIPTION OF THE DRAWINGS

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler" and variations thereof are used to include both arrangements wherein the two or more components are in direct physical contact and arrangements wherein the two or more components are not in direct contact with each other (e.g., the components are "coupled" via at least a third component, but yet still cooperate or interact with each other).

In some instances throughout this disclosure and in the claims, numeric terminology, such as first, second, third, and fourth, is used in reference to various components or features. Such use is not intended to denote an ordering of the components or features. Rather, numeric terminology is used to assist the reader in identifying the component or features being referenced and should not be narrowly interpreted as providing a specific order of components or features.

Referring to FIG. 1, a mortise lock system 100 is represented. Mortise lock system 100 includes a mortise lock housing 102 which is received in a mortise opening (not shown) in a door (not shown). A pair of operator input devices 110A, 110B extend from the mortise lock housing 102 with operator input device 110A positioned on a first side 104 of mortise lock housing 102 and operator input device 110B positioned on a second side 106 of mortise lock housing 102.

Operator input devices 110A, 110B are coupled to respective latch hubs 112A, 112B through spindle shafts 114A, 114B. Latch hubs 112A, 112B are part of a retraction assembly 120 of mortise lock system 100. Retraction assembly 120 further includes a retractor 122 which is operatively coupled to both of latch hubs 112A, 112B and to latch bolt 124. Exemplary retractors include levers and other devices which are capable of applying a mechanical force, directly or indirectly, to latch bolt 124. As is known, latch bolt 124 generally extends beyond mortise lock housing 102 to engage with a recess in a corresponding door strike to lock the door in a closed position, but may be retracted further into or completely within mortise lock housing 102 to disengage the latch bolt 124 from the recess in the corresponding door strike to unlock the door.

Each of operator input devices 110A, 110B and latch hubs 112A, 112B are rotatable about axis 126. Through a rotation of operator input device 110A, hub 112A actuates retractor 122 which in turn actuates latch bolt 124 to move the latch bolt 124 from an extended position relative to the mortise lock housing 102 to a retracted position relative to the mortise lock housing 102. In a similar manner, through a rotation of operator input device 110B, hub 112B actuates retractor 122 which in turn actuates latch bolt 124 to move the latch bolt 124 from an extended position relative to the mortise lock housing 102 to a retracted position relative to the mortise lock housing 102. Mortise lock assembly 100 is illustrated with two independently actuatable hubs 112A, 112B. In embodiments, a single hub may be used in place of latch hubs 112A, 112B.

A hub lock 140 is operatively coupled to one or both of latch hubs 112A, 112B and positionable in a first position wherein each of latch hubs 112A, 112B are capable of being rotated about axis 126 to move latch bolt 124 to the retracted position and a second position wherein only one of latch hubs 112A, 112B is capable of being rotated about axis 126 to move latch bolt 124 to the retracted position. In embodiments, when hub lock 140 is in the second position the operator input device 110A which is positioned on an interior side of the door may be rotated about axis 126 to cause a rotation of latch hub 112A about axis 126 and hence a retraction of latch bolt 124 and the operator device 110B which is positioned on an exterior side of the door is prohibited from rotating about axis 126, thereby blocking rotation of latch hub 112B about axis 126.

Hub lock 140 is movable from the first position to the second position by a plurality of independent hub lock actuators, illustratively hub lock actuator 150 and hub lock actuator 160. In embodiments, each of hub lock actuator 150 and hub lock actuator 160 are supported by a housing of mortise lock housing 102. Each of hub lock actuator 150 and hub lock actuator 160 is capable of moving hub lock 140 from the first position to the second position independent of the other of hub lock actuator 150 and hub lock actuator 160.

In embodiments, hub lock actuator 150 is driven by a mechanical input 152 while hub lock actuator 160 is driven by an electrical input 162. Exemplary mechanical inputs 152 include a rotation of cam driven by a key rotated in a mortise cylinder, a rotation of a thumb knob, or a rotation and/or translation of another operator input device which, in turn, causes a movement of hub lock actuator 150. Exemplary electrical inputs 162 include a received wired electrical communication signals, a voltage change on a wired electrical connection, and a received wireless electrical communication signals.

In the illustrated embodiment of FIG. 1, a wireless signal is received by an electrical controller 164 through a receiver 166. The wireless signal is sent by a transmitter 168 under the control of a separate electrical controller 170. Electrical controller 164 includes logic which based on the received signal may provide an electrical input 162 to hub lock actuator 160 to actuate hub lock 140. As disclosed herein, exemplary hub lock actuator 160 may include a motor which drives a movement of another component of hub lock actuator 160. Receiver 166 and transmitter 168 may, in embodiments, be transceivers to permit two-way communication between electrical controller 164 and electrical controller 170.

As stated herein, electronic controller 164 includes logic which controls the operation of hub lock actuator 160. In embodiments, the logic may be software instructions and data stored on memory 172 which is accessible by electrical controller 164 for execution. The term "logic" as used herein includes software and/or firmware executing on one or more programmable processors, application-specific integrated circuits, field-programmable gate arrays, digital signal processors, hardwired logic, or combinations thereof. Therefore, in accordance with the embodiments, various logic may be implemented in any appropriate fashion and would remain in accordance with the embodiments herein disclosed. A non-transitory machine-readable medium comprising logic can additionally be considered to be embodied within any tangible form of a computer-readable carrier, such as solid-state memory, magnetic disk, and optical disk containing an appropriate set of computer instructions and data structures that would cause a processor to carry out the techniques described herein. This disclosure contemplates other embodiments in which electronic controller 164 is not microprocessor-based, but rather is configured to control operation of hub lock actuator 160 and/or other components of mortise lock system 100 based on one or more sets of hardwired instructions. Further, electrical controller 164 may be contained within a single device or be a plurality of devices networked together or otherwise electrically connected to provide the functionality described herein.

Electrical controller 164 is further operatively coupled to a visual indicator 174 which provides a visual cue to the environment around mortise lock system 100 of the position of hub lock 140. Exemplary visual indicators 174 include illumination devices, such as light-emitting diodes and lamps, and displays. Electrical controller 164 may further be operatively coupled to audio indicators.

Figure 2:
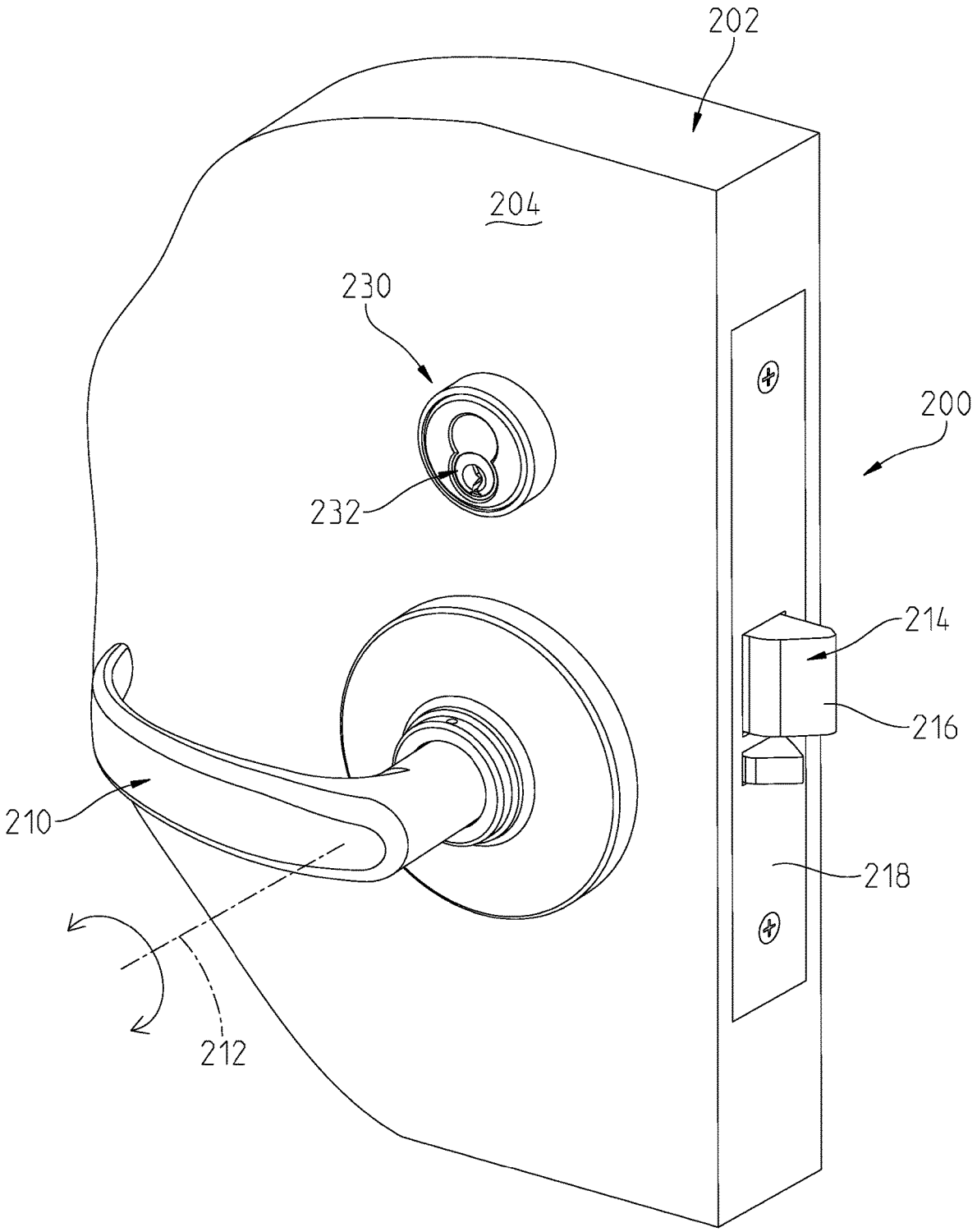
FIG. 2 illustrates an exterior face of a door including an exemplary mortise lock system of the present disclosure.
Figure 3:
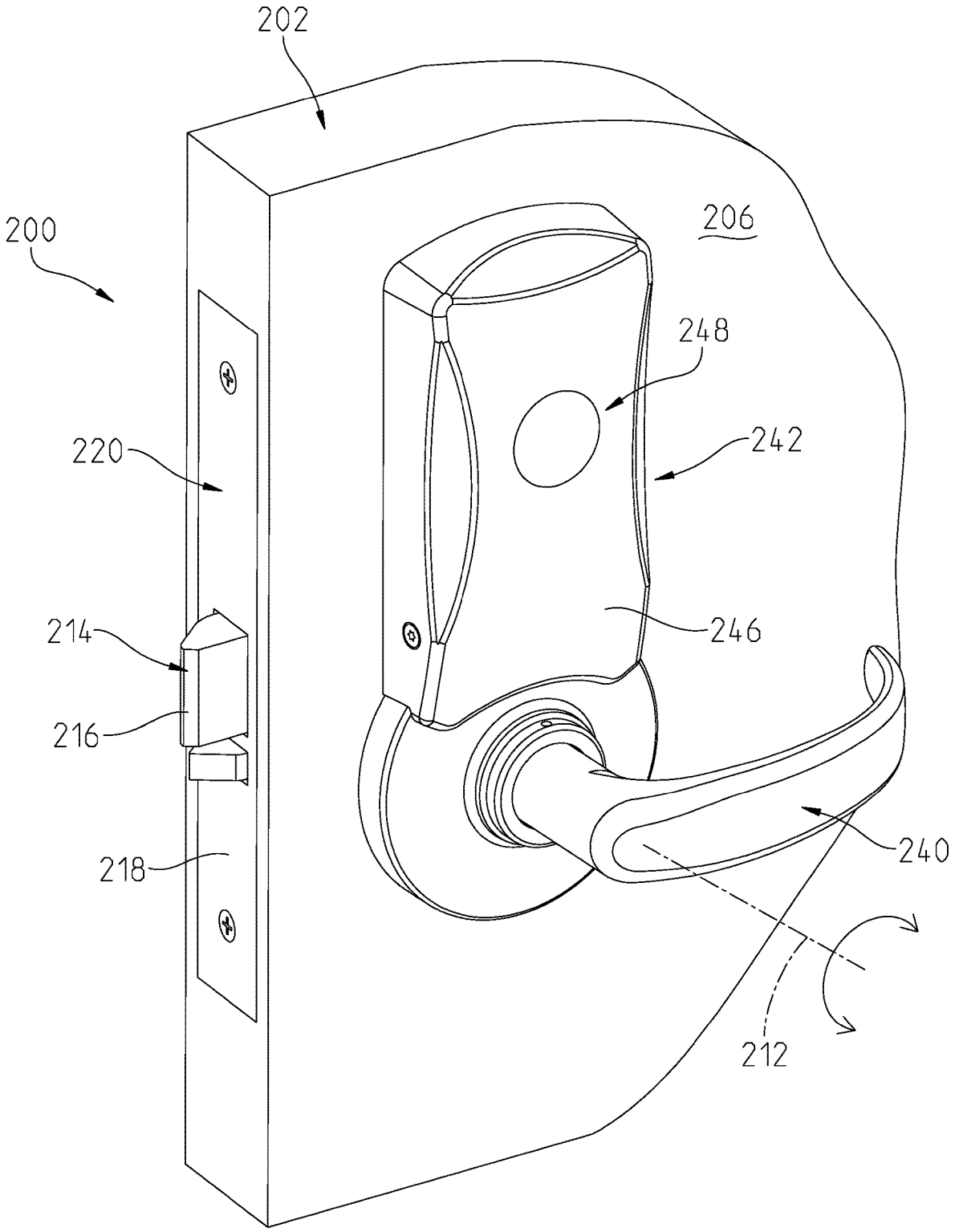
FIG. 3 illustrates an interior face of the door and mortise lock system of FIG. 2.

Referring to FIGS. 2-12, an exemplary mortise lock system 200 is shown including a mortise lock 201. Referring to FIGS. 2 and 3, mortise lock system 200 is assembled to a door 202 having an exterior face 204 (see FIG. 2) and an interior face 206 (see FIG. 3). Referring to FIG. 2, mortise lock system 200 includes an operator input device, illustratively a handle 210, which is rotatable about an axis 212. As explained in more detail herein, a rotation of handle 210 about axis 212 results in a latch bolt 214 of mortise lock system 200 moving from an extended position, as shown in FIGS. 2 and 3, to a retracted position in the direction 320 (see FIG. 8) wherein an end 216 of latch bolt 214 is closer to a face 218 of a housing 220 of mortise lock system 200 than in the extended position. In embodiments, end 216 of latch bolt 214 is retracted to one of a level wherein end 216 protrudes from face 218 by up to a few millimeters, a flush level with face 218 of housing 220, or recessed below face 218 of housing 220. Housing 220 includes a top 221 and a bottom 223. The latch bolt 214 has a top surface 213 and a bottom surface 215.

Mortise lock system 200 further includes a mortise cylinder 230 having an interchangeable core 232 which is actuatable by a key (not shown). As is known in the art, the interchangeable core 232 may be actuated to move a cam member (not shown) associated with mortise cylinder 230 that engages a component of mortise lock 201 to move latch bolt 214 from the extended position to the retracted position. In embodiments, mortise cylinder 230 has a non-interchangeable core having a keyway to receive a key.

Referring to FIG. 3, mortise lock system 200 further includes a second operator input device, illustratively a handle 240, which is rotatable about axis 212. As explained in more detail herein, a rotation of handle 240 about axis 212 results in latch bolt 214 of mortise lock system 200 moving from the extended position shown in FIGS. 2 and 3 to the retracted position.

Figure 4:
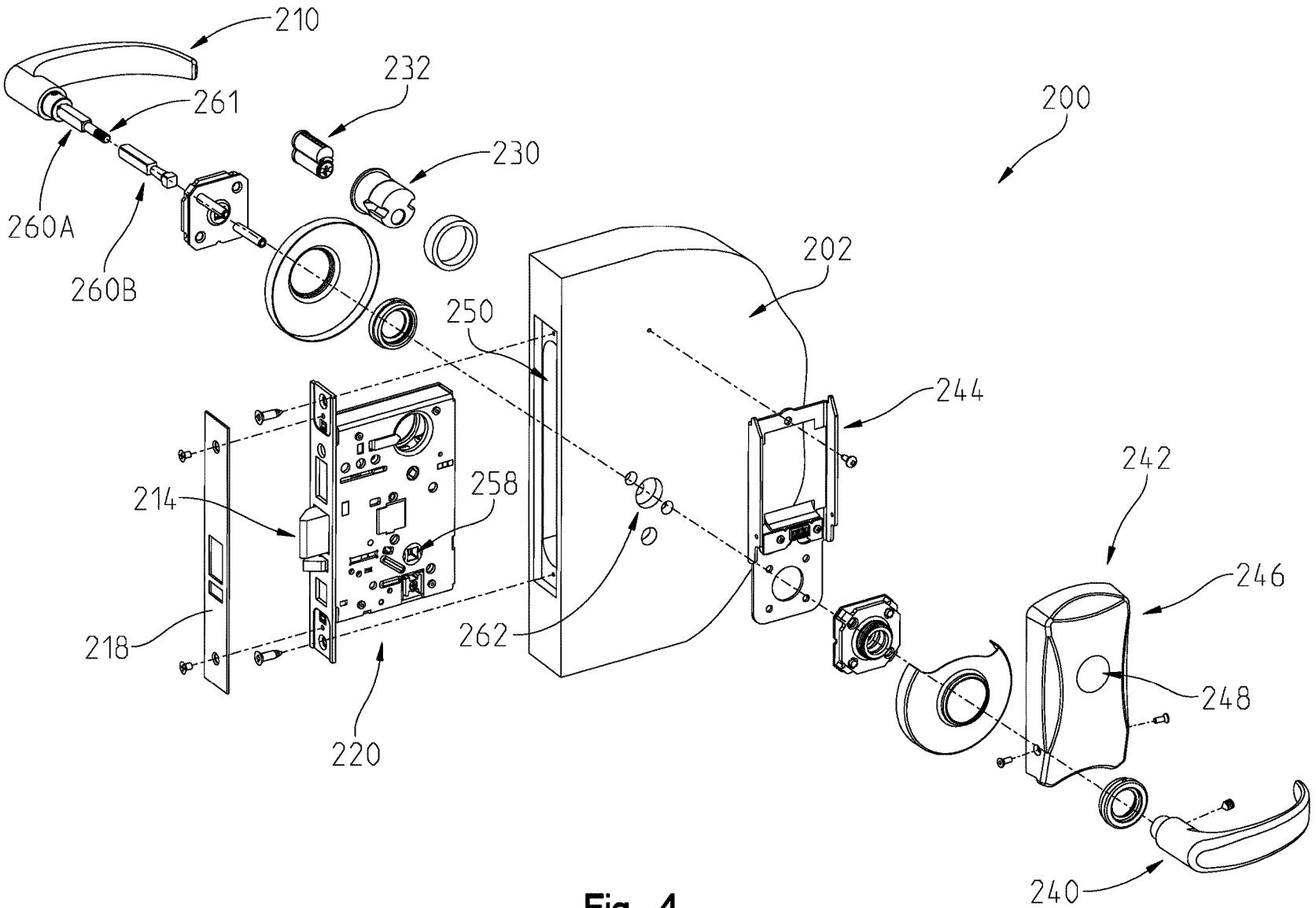
FIG. 4 illustrates an exploded view of the mortise lock system and the door of FIG. 3.
Figure 5:
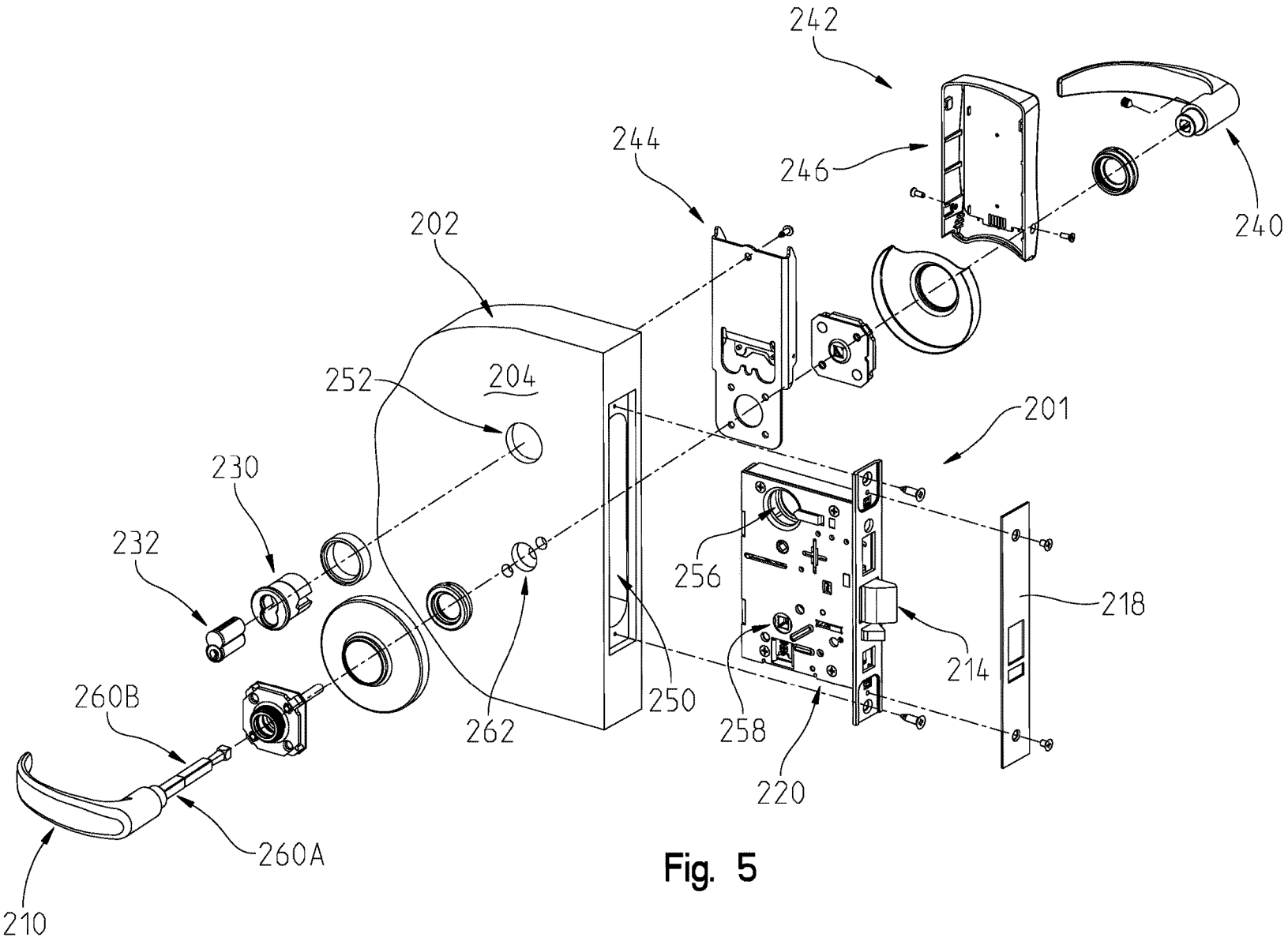
FIG. 5 illustrates an exploded view of mortise lock system and the door of FIG. 2.
Figure 6:
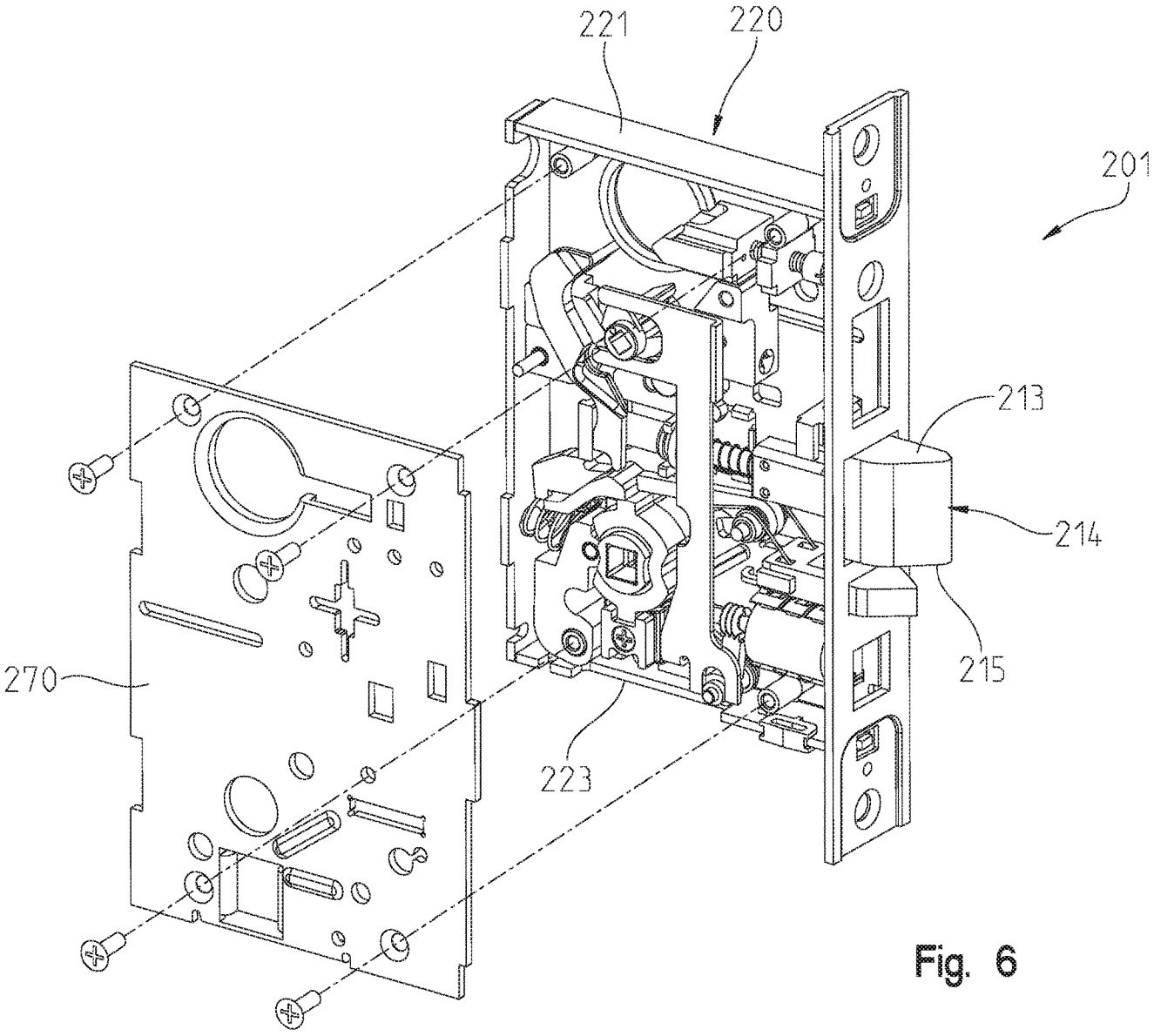
FIG. 6 illustrates the mortise lock of FIG. 2 with a cover exploded to illustrate the interior components of the mortise lock.

Mortise lock system 200 further includes a housing 242 secured to door 202 which may house multiple components of mortise lock system 200, such as electrical controller 164, receiver 166, memory 172, and visual indicator 174 of mortise lock system 200. In embodiments, one or more of electrical controller 164, receiver 166, and memory 172 are housed in housing 220 of mortise lock system 200 instead of housing 242. Further, housing 242 may house batteries or other power supplies. As shown in FIGS. 4 and 5, housing 242 includes a base 244 secured to door 202 and a cover 246 secured to base 244. An exemplary visual indicator 248 is shown being visible from an exterior of housing 242. In one embodiment, visual indicator 248 is illuminated when electrical controller 164 causes mortise lock system 200 to be placed in a locked configuration, as described in more detail herein.

Housing 220 of mortise lock 201 is received in a mortise recess 250 of door 202. Mortise cylinder 230 is received in a recess 252 from exterior face 204 of door 202. Mortise cylinder 230 is further received in an opening 256 in housing 220. This positioning of mortise cylinder 230 results in the cam member (not shown) of mortise cylinder 230 being positioned to actuate a component, illustratively lever 552 (see FIG. 8) of mortise lock 201 to retract latch bolt 214. Each of handle 210 and handle 240 have an associated spindle shaft 260A, 260B which is received within a through aperture 262 in door 202 extending from exterior face 204 to interior face 206. The spindle shafts 260A, 260B are further received in opening 258 in housing 220 of mortise lock 201. Spindle shafts 260A, 260B are coupled together through a threaded shaft 261. In embodiments, spindle shaft 260A is permanently coupled to handle 210 and spindle shaft 260B is threaded onto threaded shaft 261 as far as possible and subsequently rotated back at least one full rotation of spindle shaft 260B. This permits spindle shafts 260A, 260B to rotate independent of each other while maintaining spindle shafts 260A, 260B in a coupled arrangement which, in turn, allows handle 240 to be rotated independent of handle 210. Handle 240 is attached to spindle shaft 260B through a set screw (not shown).

Figure 7:
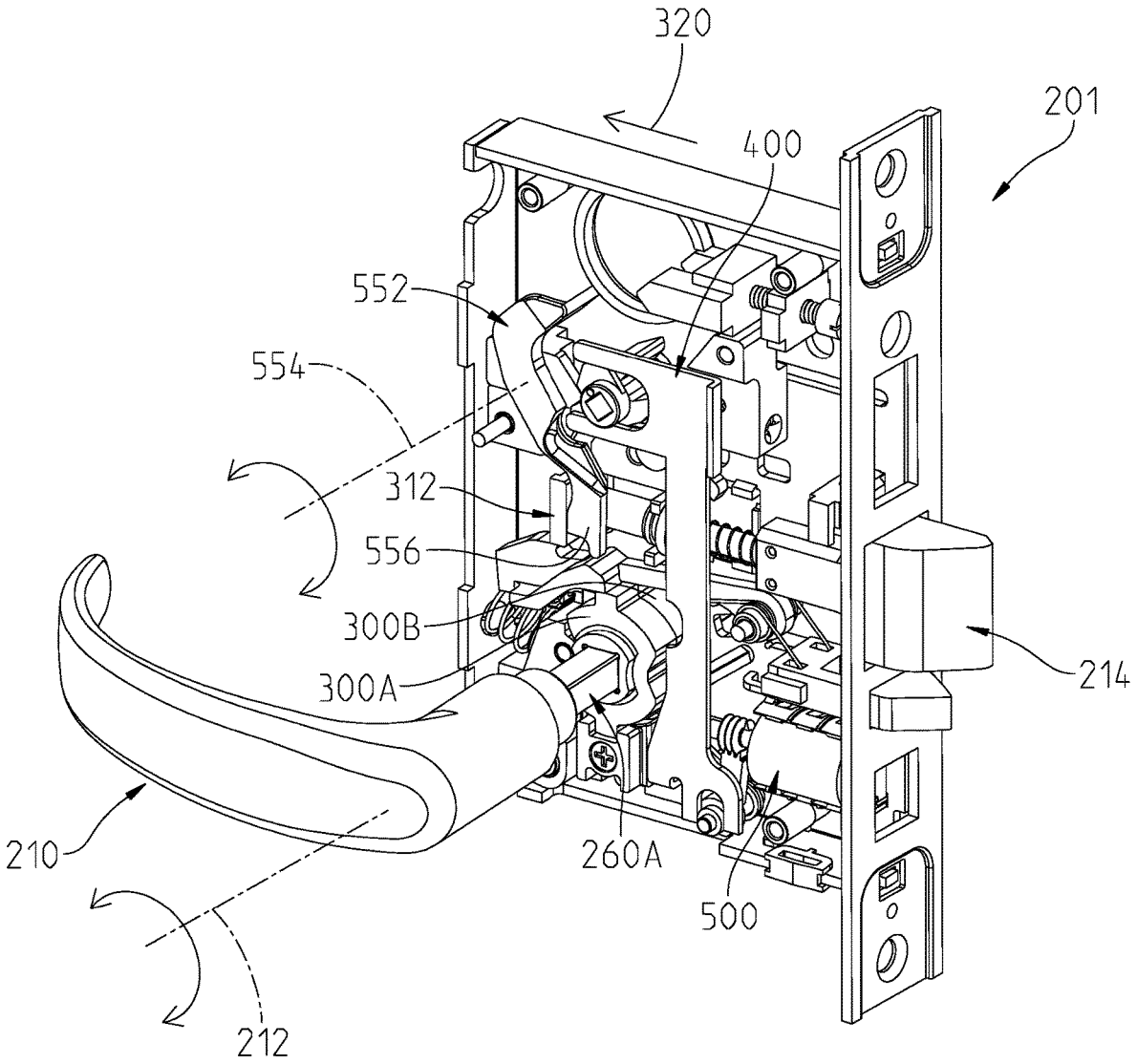
FIG. 7 illustrates the mortise lock of FIG. 6 with the cover removed and an operator input device coupled to a latch hub of the mortise lock.
Figure 8:
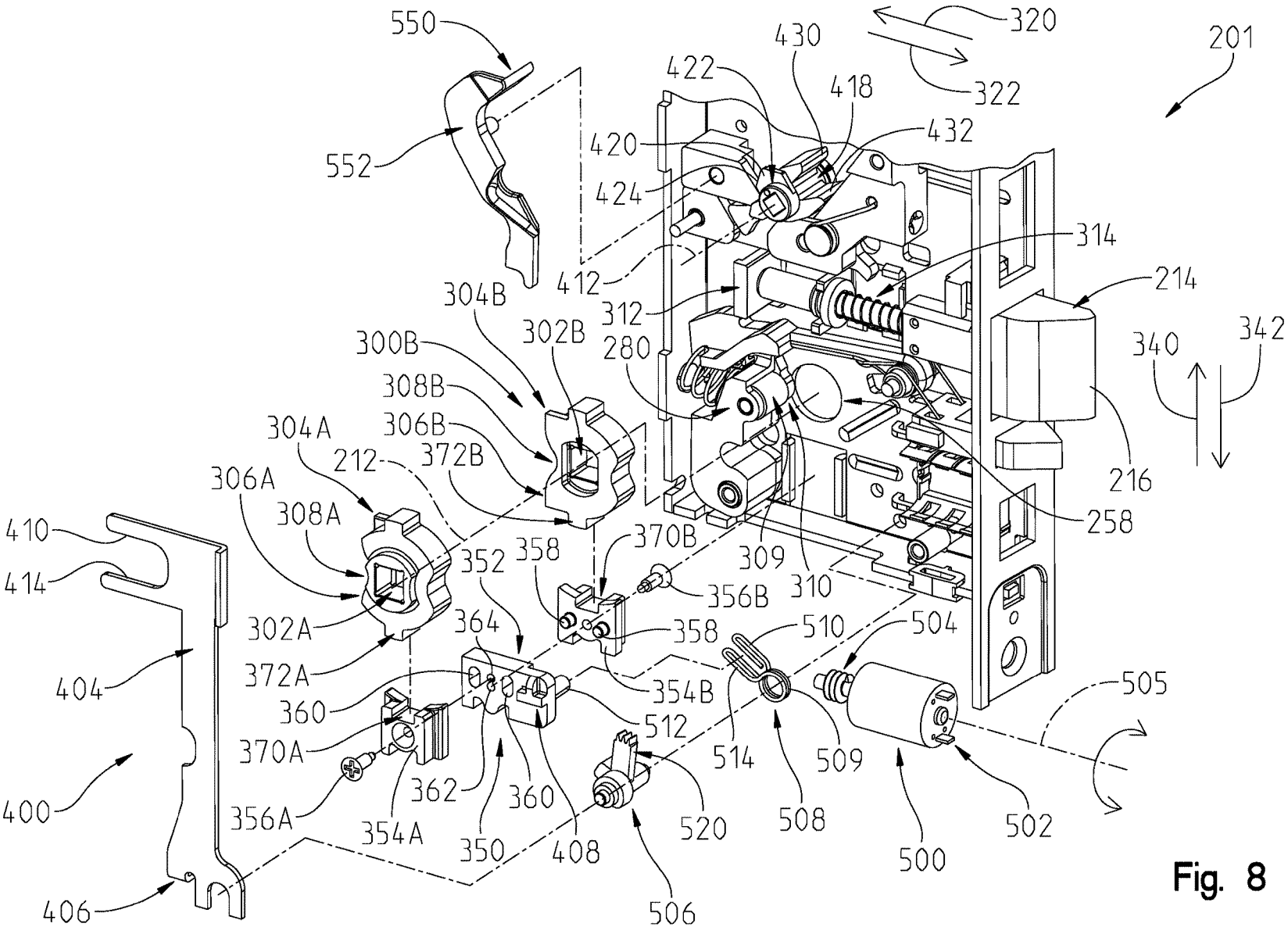
FIG. 8 illustrates a partial exploded view of the mortise lock of FIG. 6.

Referring to FIG. 8, mortise lock 201 includes latch hubs 300A, 300B. Each latch hub 300A, 300B includes a central opening 302A, 302B which receives a respective spindle shaft 260A, 260B (see FIG. 7 for spindle shaft 260A received within opening 302A of latch hub 300A). Each latch hub 300A, 300B is independently rotatable about axis 212 by the respective handles 210, 240.

Returning to FIG. 8, each latch hub 300A, 300B is part of a retraction assembly 280 which is actuatable to retract latchbolt 214. Each latch hub 300A, 300B includes a cam surface 308A, 308B extending from an upper engagement feature, illustratively projections 304A, 304B and a lower engagement feature, illustratively projections 306A, 306B.

The respective cam surface 308A, 308B of the respective latch hub 300A, 300B being rotated engages with a roller 309. As the respective latch hub 300A, 300B is being rotated, roller 309 due to engagement with the respective cam surface 308A, 308B is moved generally rearward in direction 320. Roller 309 is coupled to a lever 310 which extends upward to the latch bolt 314. The rearward movement of roller 309 results in lever 310 being rotated resulting in an upper portion of lever 310 being also moved generally rearward in direction 320. This rearward movement of lever 310 in turn results in lever 310 pressing against a flange 312 of latch bolt 214 to also move latch bolt 214 generally in direction 320 towards a retracted position of latch bolt 214. Latch bolt 214 is generally biased towards the extended position shown in FIG. 8 by a spring 314 carried by latch bolt 214.

One or both of latch hubs 300A, 300B may be inhibited from rotating about axis 212 based on a position of a hub lock 350. Hub lock 350 is movable in direction 340 to engage one or both of latch hubs 300A, 300B and inhibit rotation of the one or more latch hubs 300A, 300B about axis 212 and in direction 342 to disengage from the one or more latch bolts 300A, 300B to allow rotation of latch hubs 300A, 300B about axis 212. As discussed herein, hub lock 350 is configurable to engage only latch hub 300A, only latch hub 300B, or both of latch hubs 300A, 300B when moved in direction 340.

Figure 9A:
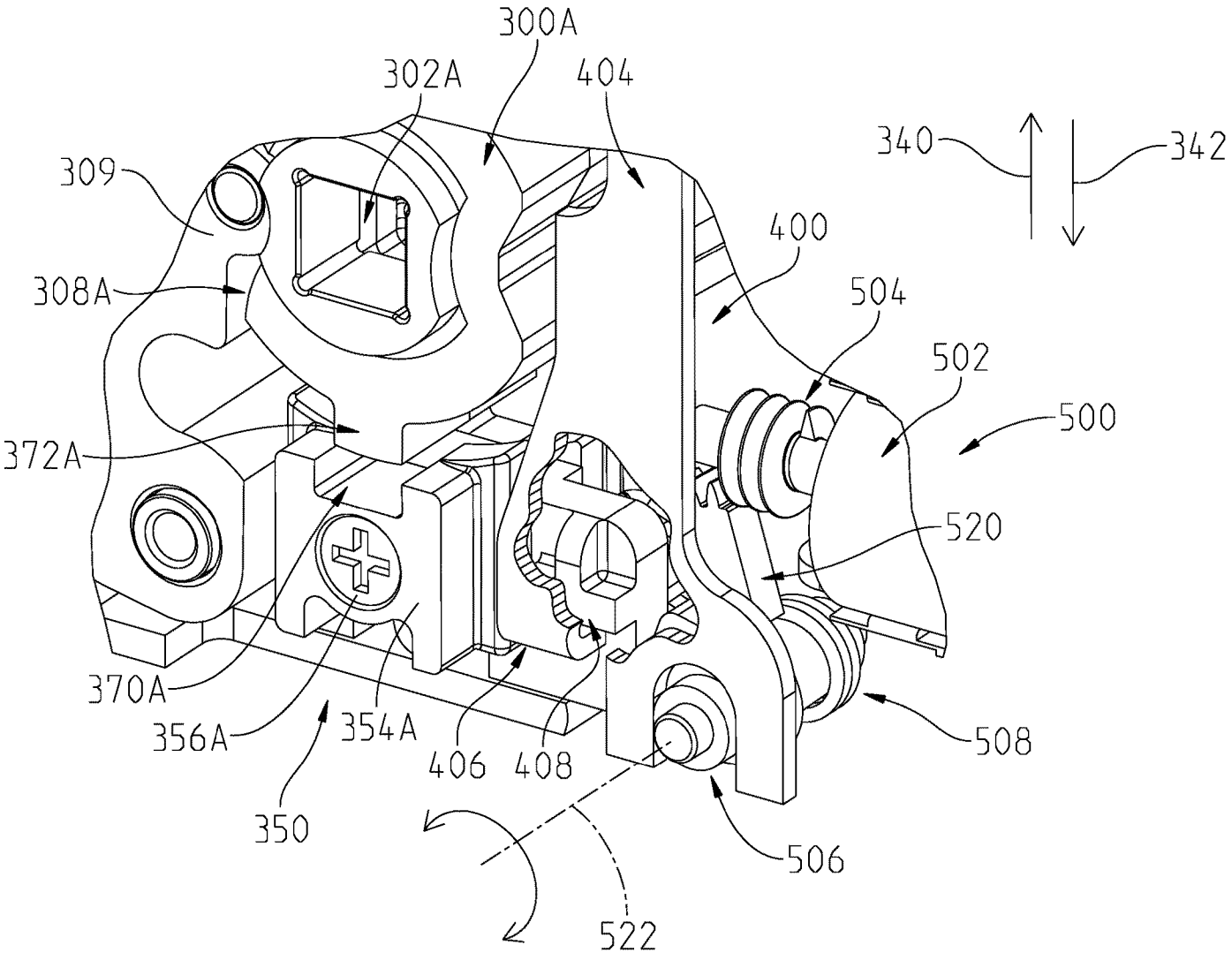
FIGS. 9A and 9B illustrate a mechanical hub lock actuator of the mortise lock in an unlocked position whereby an engagement feature of a hub lock of the mortise lock is disengaged from an engagement feature of the latch hub of the mortise lock.
Figure 9B:
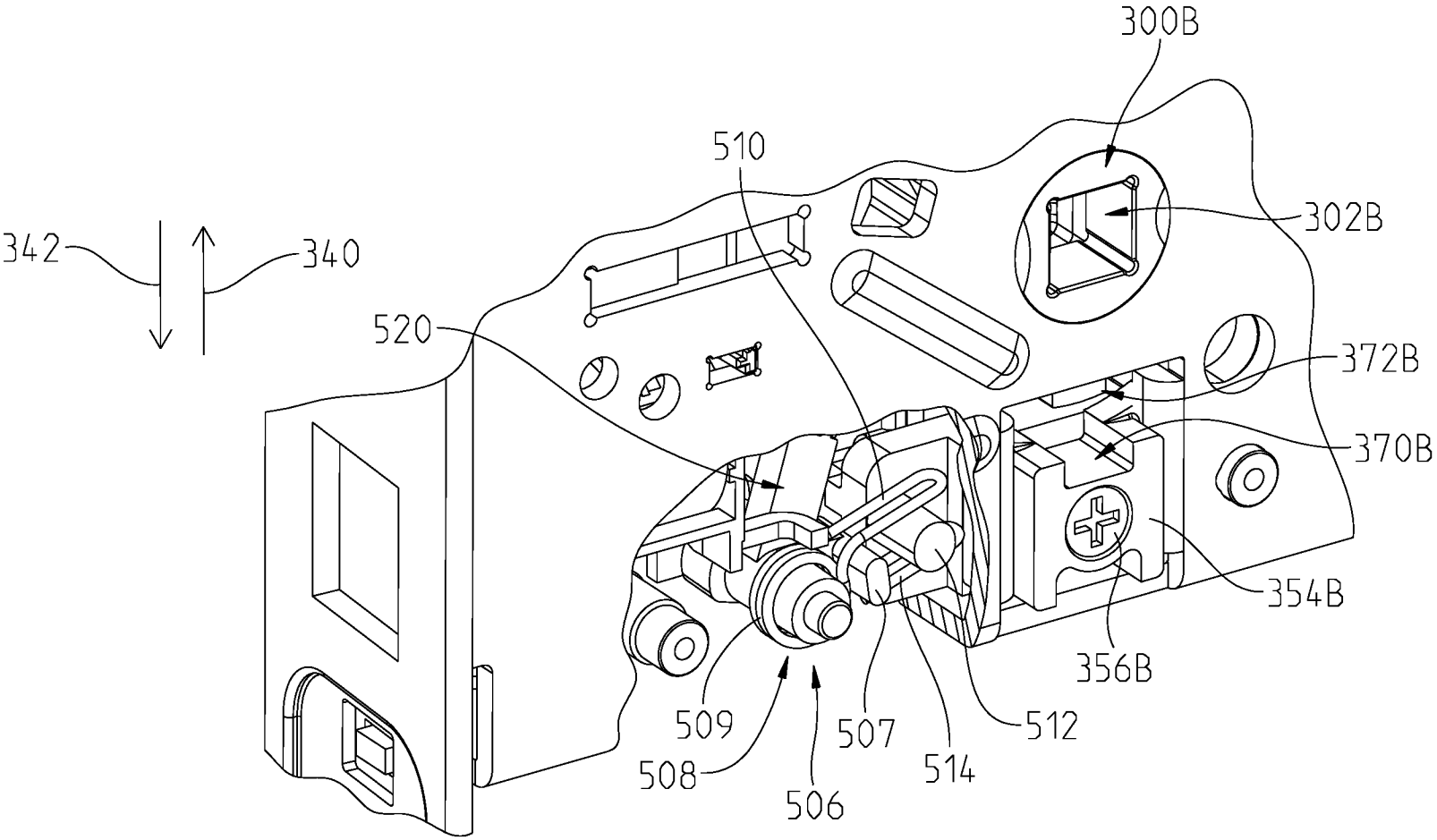
Figure 10A:
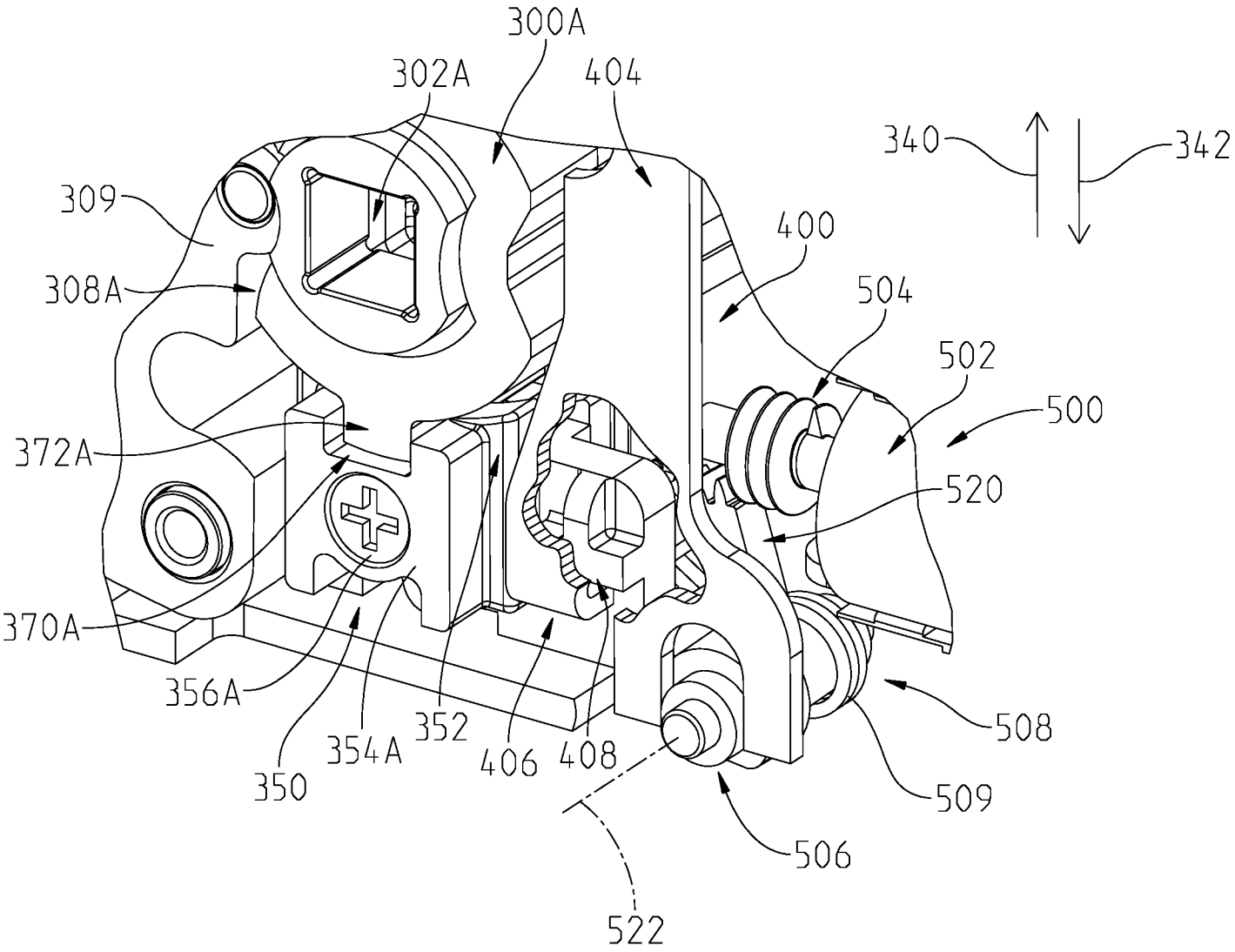
FIGS. 10A and 10B illustrate the mechanical hub lock actuator of the mortise lock shown in FIGS. 9A and 9B in a locked position whereby the engagement feature of the hub lock of the mortise lock is engaged with the engagement feature of the latch hub of mortise lock.
Figure 10B:
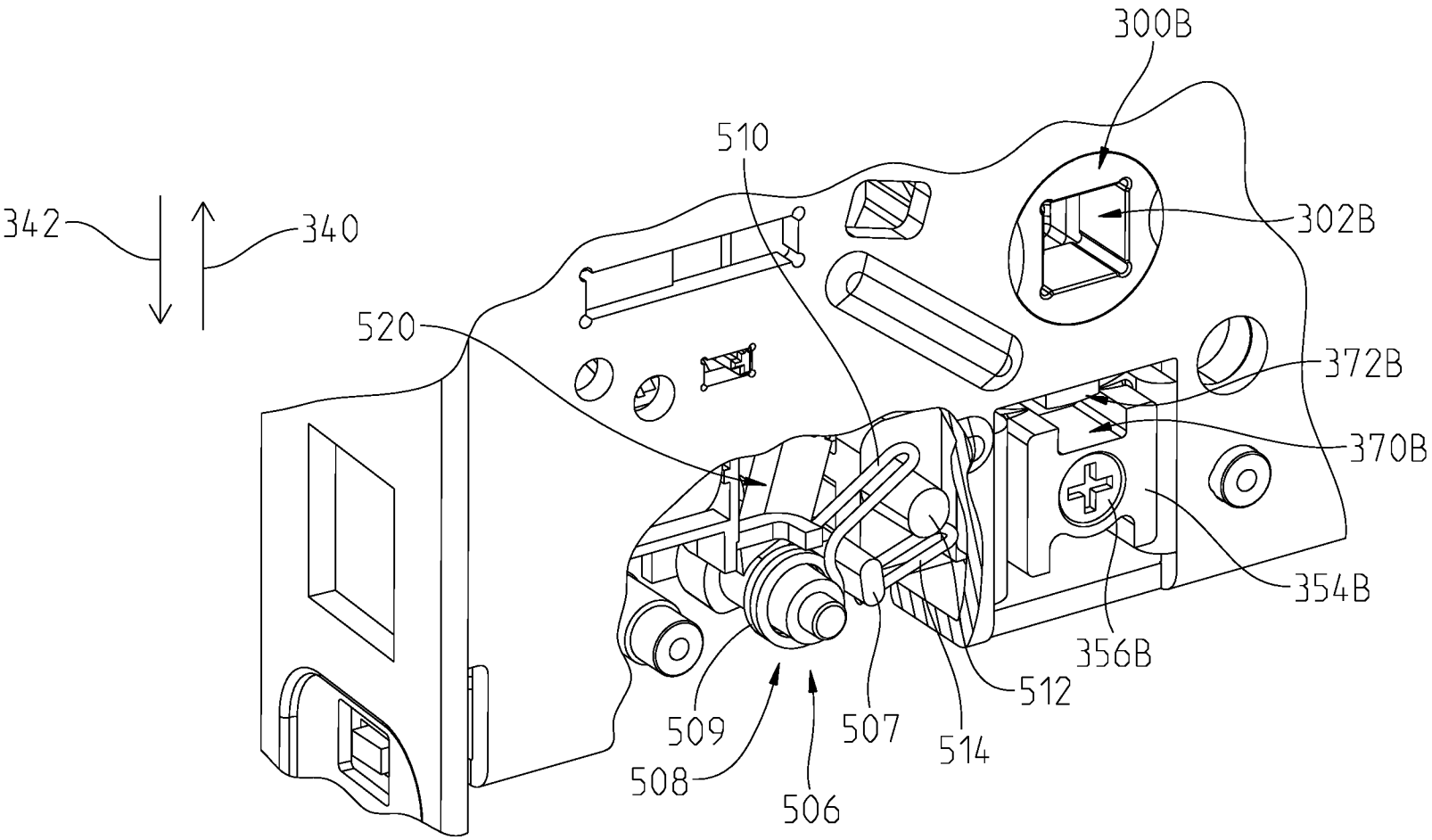
Figure 11:
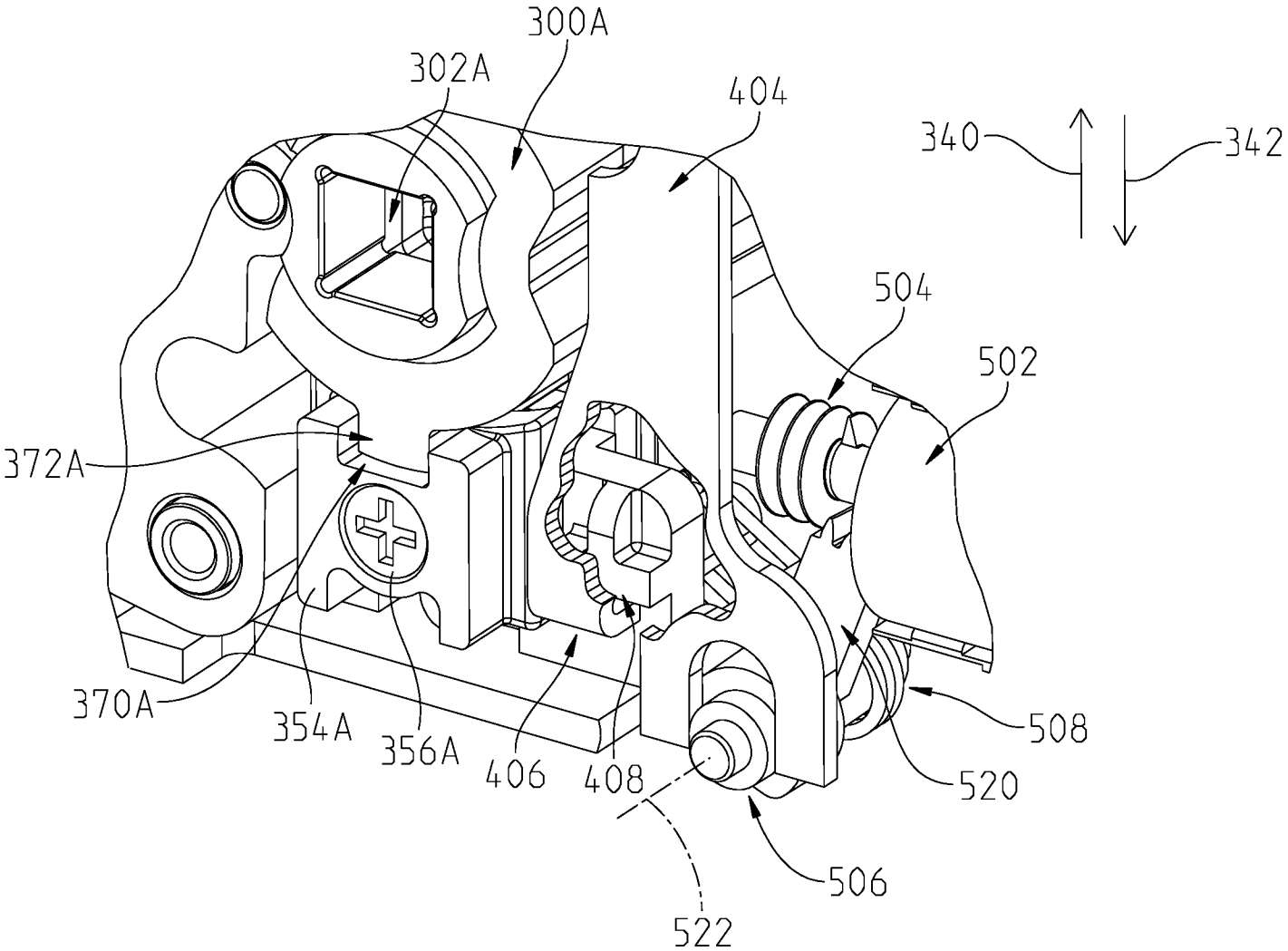
FIG. 11 illustrates the arrangement of FIG. 10A for the mechanical hub lock actuator and an electrically driven hub actuator of the mortise lock also in a locked position in response to a received lockdown signal from a remote device.

Referring to FIGS. 9A, 9B, 10A, and 10B, locking toggle 354A is secured to base member 352 with fastener 356A received in upper mounting aperture 364 and locking toggle 354B is secured to base member 352 with fastener 356B received in lower mounting aperture 362. As shown in FIGS. 9A and 9B, when hub lock 350 is moved downward in direction 342 both pocket 370A of first locking toggle 354A and pocket 370B of second locking toggle 354B are disengaged from the respective projections 372A, 372B of the respective latch hubs 300A, 300B. Thus, each of latch hubs 300A, 300B are capable of rotation about axis 212. As shown in FIGS. 10A and 10B, hub lock 350 is moved upward in direction 340 and pocket 370A of first locking toggle 354A is engaged with projection 372A of latch hub 300A while pocket 370B of second locking toggle 354B remains disengaged from projection 372B of latch hub 300B. Thus, latch hub 300B continues to be capable of rotation about axis 212 while latch hub 300A is inhibited from being rotated relative to axis 212. This results in handle 210 positioned on exterior face 204 of door 202 being locked (not permitting retraction of latch bolt 214) and handle 240 positioned on interior face 206 of door 202 being unlocked (permitting retraction of latch bolt 214).

Each locking toggle 354A, 354B is coupled to base member 352 of hub lock 350 through a respective fastener 356A, 356B. Locking toggles 354A, 354B include pins 358 which are received in openings 360 of base member 352. Pins 358 and openings 360 cooperate to orient locking toggles 354A, 354B relative to base member 352.

Base member 352 of hub lock 350 further includes a lower mounting aperture 362 and an upper mounting aperture 364. Fasteners 356A, 356B can secure the respective locking toggle 354A, 354B to base member 352 by being threaded into either of lower mounting aperture 362 or upper mounting aperture 364.

As explained in more detail herein, hub lock 350 may be moved between an upper position in direction 340 due to an actuation of one of a plurality of hub lock actuators and a lower position in direction 342. If locking toggle 354A or locking toggle 354B is secured to base member 352 by the respective fastener 356A, 356B being received in the lower mounting aperture 362, then the respective engagement feature 370A, 370B of the respective locking toggle 354A, 354B is not engaged with the corresponding engagement feature 372A, 372B of the respective latch hub 300A, 300B when hub lock 350 is moved to the upper position. If locking toggle 354A or locking toggle 354B is secured to base member 352 by the respective fastener being received in the upper mounting aperture 364, then the respective engagement feature 370A, 370B of the respective locking toggle 354A, 354B is engaged with the corresponding engagement feature 372A, 372B of the respective latch hub 300A, 300B when hub lock 350 is moved to the upper position. An advantage, among others, of the modularity of hub lock 350 is that mortise lock 201 may be reconfigured for a left-handed door installation or a right-handed door installation.

Referring to FIGS. 9A, 9B, 10A, and 10B, locking toggle 354A is secured to base member 352 with fastener 356A received in upper mounting aperture 364 and locking toggle 354B is secured to base member 352 with fastener 356B received in lower mounting aperture 362. As shown in FIGS. 9A and 9B, when hub lock 350 is moved downward in direction 342 both pocket 370A of first locking toggle 354A and pocket 370B of second locking toggle 354B are disengaged from the respective projections 372A, 372B of the respective latch hubs 300A, 300B. Thus, each of latch hubs 300A, 300B are capable of rotation about axis 212. As shown in FIGS. 10A and 10B, hub lock 350 is moved upward in direction 340 and pocket 370A of first locking toggle 354A is engaged with projection 372A of latch hub 300A while pocket 370B of second locking toggle 354B remains disengaged from projection 372B of latch hub 300B. Thus, latch hub 300B continues to be capable of rotation about axis 212 while latch hub 300A is inhibited from being rotated relative to axis 212. This results in handle 210 positioned on exterior face 204 of door 202 being locked (not permitting retraction of latch bolt 214) and handle 240 positioned on interior face 206 of door 202 being unlocked (permitting retraction of latch bolt 214).

The positioning of hub lock 350 in either the raised position of FIGS. 10A and 10B or the lowered position of FIGS. 9A and 9B, is controlled by a plurality of hub lock actuators. In the illustrated embodiment, mortise lock 201 includes a first, mechanically driven hub lock actuator system 400 (see FIGS. 7 and 8) and a second, electrically driven hub lock actuator system 500 (see FIGS. 7 and 8).

Referring to FIG. 8, mechanically driven hub lock actuator system 400 includes a locking lever 404. Locking lever 404 has a hub lock engagement feature, illustratively a projection 406, which engages with an engagement feature, illustratively a projection 408, of hub lock 350. As shown in FIG. 10A, an upper surface of projection 406 engages a lower surface of projection 408 when locking lever 404 is raised in direction 340; thereby raising hub lock 350 in direction 340.

Mechanically driven hub lock actuator system 400 further includes a cam 420 supported on a rotatable base member 418 which is rotatable about an axis 412. Cam 420 has a first surface 422 which contacts surface 410 of locking lever 404 as rotatable base member 418 is rotated clockwise about axis 412 to raise locking lever 404 in direction 340. Cam 420 has a second surface 424 which contacts surface 414 of locking lever 404 as rotatable base member 418 is rotated counterclockwise about axis 412 to lower locking lever 404 in direction 342.

In embodiments, rotatable base member 418 is coupled to a mechanical input, such as a thumb knob accessible from interior side 206 of door 202 or a mortise cylinder 230 actuatable by a key from exterior side 204 of door 202. In the illustrated embodiment, rotatable base member 418 includes projections 430 and 432 which cooperate with a cam member (not shown) rotatable by mortise cylinder 230 such that locking lever 404 may be raised in direction 340 or lowered in direction 342 through rotation of an authorized key inserted into interchangeable core 232.

Returning to FIG. 8, electrically driven hub lock actuator system 500 includes a motor 502, a worm gear 504 rotatable about a drive axis 505 of motor 502, a sector gear 520 supported by a base member 506, and a spring element 508. As a drive shaft of motor 502 rotates about drive axis 505, worm gear 504 also rotates about drive axis 505. Worm gear 504 is engaged with the teeth of sector gear 520 and base member 506 is rotatable relative to housing 220 about axis 522 (see FIG. 9A) such that a rotation of worm gear 504 in a first direction causes base member 506 to rotate clockwise and a rotation of worm gear 504 in a second direction causes base member 506 to rotate counterclockwise.

Spring element 508 includes a coil portion 509, a first leg portion 510, and a second leg portion 514. Coil portion 509 is carried by base member 506 and base member includes a projection 507 (see FIGS. 9B and 10B) that is positioned between first leg portion 510 and second leg portion 514. When base member 506 rotates clockwise first leg portion 510 and second leg portion 514 also rotate clockwise and when base member 506 rotates counterclockwise first leg portion 510 and second leg portion 514 also rotate counterclockwise.

First leg portion 510 and second leg portion 514 of spring element 508 capture a projection 512 of base member 352 of hub lock 350. When base member 506 rotates clockwise hub lock 350 is raised in direction 340 due to first leg portion 510 and second leg portion 514 which have captured projection 512 also rotating clockwise. When base member 506 rotates counterclockwise hub lock 350 is lowered in direction 342 due to first leg portion 510 and second leg portion 514 which have captured projection 512 also rotating counterclockwise. An advantage, among others, of utilizing spring element 508 instead of a rigid connection between base member 506 and hub lock 350 is that first leg portion 510 and second leg portion 514 may flex if the movement of hub lock 350 is blocked either due to a misalignment of latch hubs 300A, 300B with hub lock 350 or due to mechanically driven hub lock actuator system 400 having raised hub lock 350 in direction 340.

Mechanically driven hub lock actuator system 400 and electrically driven hub lock actuator system 500 are independently actuatable to move hub lock 350 to the locked (raised) position. Referring to FIG. 10A, mechanically driven hub lock actuator system 400 has been actuated to raise hub lock 350 to the locked (raised) position due to projection 406 of lock lever 404 contacting projection 408 of hub lock 350 and raising projection 408 in direction 340. As shown in FIG. 10A, electrically driven hub lock actuator system 500 remains in a configuration which would normally correspond to hub lock 350 being in the unlocked (lowered) position of FIG. 9A with sector gear 520 rotated counterclockwise about axis 522. As shown in FIG. 10B, projection 512 of hub lock 350 has been raised in direction 340 and caused a deflection of first leg portion 510 of spring element 508 of electrically driven hub lock actuator system 500. Referring to FIG. 9A, mechanically driven hub lock actuator system 400 has been actuated to lower hub lock 350 to the unlocked (lowered) position due to projection 406 being lowered in direction 342. Hub lock 350 is also lowered in direction 342 due to the spring force of spring element 508. As shown in FIG. 9B, projection 512 of hub lock 350 has been lowered in direction 342 and projection 512 contacts both of first leg portion 510 and second leg portion 514 of spring element 508.

Figure 12:
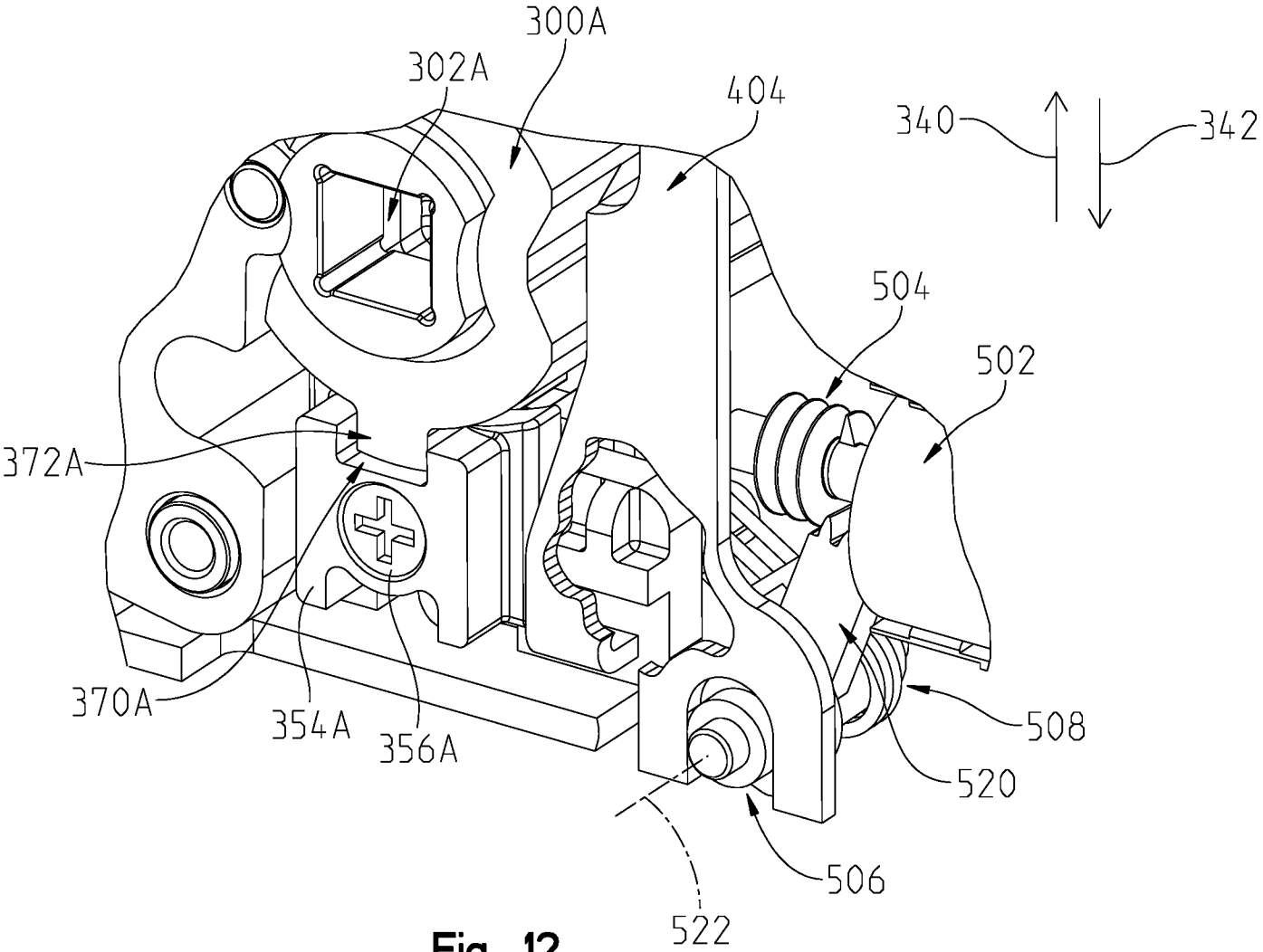
FIG. 12 illustrates the arrangement of FIG. 9A for the mechanical hub lock actuator and the electrically driven hub actuator of the mortise lock positioned in a locked position in response to the received lockdown signal from the remote device.

In a similar fashion, electrically driven hub lock actuator system 500 may be actuated to raise hub lock 350 to the locked (raised) position independent of mechanically driven hub lock actuator system 400. Referring to FIG. 12, motor 502 has rotated worm gear 504 to rotate sector gear 520 clockwise about axis 522. This rotation causes second leg portion 514 to raise projection 512 and hence hub lock 350 to the locked (raised) position shown in FIG. 12. As shown in FIG. 12, locking lever 404 remains in the lowered position and projection 408 of hub lock 350 is spaced apart from projection 406 of locking lever 404. Raising locking lever 404 in direction 340 causes no change in the state of hub lock 350 (see FIG. 11).

In embodiments, although both mechanically driven hub lock actuator system 400 and electrically driven hub lock actuator system 500 may be moved to their corresponding locked positions, neither of mechanically driven hub lock actuator system 400 nor electrically driven hub lock actuator system 500 may move hub lock 350 from the locked position to the unlocked position unless the other of mechanically driven hub lock actuator system 400 and electrically driven hub lock actuator system 500 is also in its corresponding unlocked position.

In both the locked position of hub lock 350 shown in FIG. 12 due to electrically driven hub lock actuator system 500 and the locked position of hub lock 350 shown in FIG. 10A due to mechanically driven hub lock actuator system 400, second locking toggle 354B of hub lock 350 remains spaced apart from latch hub 300B. Therefore, even though handle 210 is inhibited from rotation about axis 212, handle 240 is capable of rotation about axis 212 to retract latch bolt 214.

Even when hub lock 350 is in the locked position of either FIG. 10A due to mechanically driven hub lock actuator system 400 or FIG. 12 due to electrically driven hub lock actuator system 500, a key (not shown) may be used to retract latch bolt 214 due to a cam member (not shown) of mortise cylinder 230 being rotated to contact an engagement surface 550 of a lever 552 which is rotatably coupled to mortise lock housing 220 about axis 554 (see FIG. 7). Lever 552 is rotated clockwise and a lower portion 556 of lever 552 translates flange 312 in direction 320 (see FIG. 8) to retract latch bolt 214.

Figure 13:
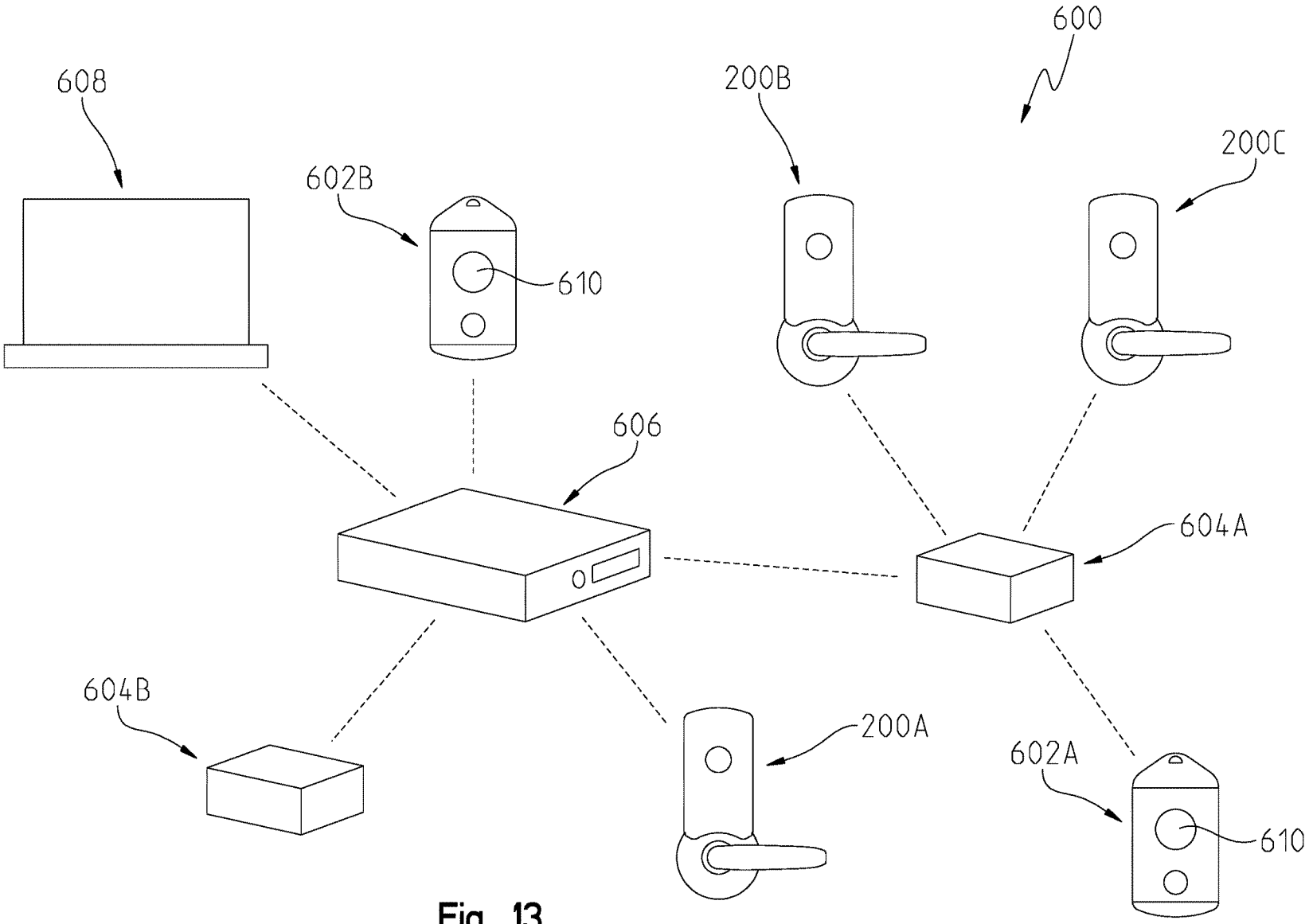
FIG. 13 illustrates an exemplary system including a plurality of mortise locks of FIG. 2 and exemplary remote devices for sending a lockdown input signal to the plurality of mortise locks.

Referring to FIG. 13, mortise lock systems 200, in one embodiment, are part of a networked system 600 which sends lockdown commands to mortise lock systems 200 to actuate electrically driven hub lock actuator system 500 and place handle 240 in a locked state. When handle 240 of mortise lock systems 200 are locked due to the reception of a lockdown signal visual indicator 248 on an interior side 206 of door 202 flashes red and an audio announcer (not shown) may be activated.

The lockdown signal may be sent by a handheld device 602 or a remote computer 608. Exemplary handheld devices 602 include fobs and cellular phones having an input 610, such as a button or touch region on a display, that is actuated or selected. Handheld device 602 and remote computer 608 communicate with mortise lock systems 200 through various network components, such as network repeaters 604 and gateways 606. In embodiments, remote computer 608 communicates with mortise lock systems 200 through a gateway 606 which is coupled to a local area network, wide area network, or Internet. Additional details of exemplary lockdown systems are provided in PCT Published Application WO2012/116037, titled WIRELESS LOCK WITH LOCKDOWN, the entire disclosure of which is expressly incorporated by reference herein.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

I claim:

1. A mortise lock, comprising:

a mortise housing;

a latch bolt moveable between an extended position and a retracted position;

a first latch hub supported by the mortise housing and operatively coupled to the latch bolt;

a second latch hub supported by the mortise housing and operatively coupled to the latch bolt independent of the first latch hub;

a hub lock moveable between (a) a first position wherein each of the first latch hub and the second latch hub are capable of being rotated to move the latch bolt to the retracted position and (b) a second position wherein only one of the first latch hub and the second latch hub is capable of being rotated to move the latch bolt to the retracted position;

a first hub lock actuator supported by the mortise housing; and a second hub lock actuator supported by the mortise housing, each of the first hub lock actuator and the second hub lock actuator is capable of moving the hub lock from the first position to the second position independent of the other of the first hub lock actuator and the second hub lock actuator.

2. The mortise lock of claim 1, wherein once the hub lock is in the second position due to an actuation of one of the first hub lock actuator and the second hub lock actuator, a subsequent actuation of the other of the first hub lock actuator and the second hub lock actuator is unable to return the hub lock back to the first position.

3. The mortise lock of claim 1, wherein the second hub lock actuator is driven in response to an electrical input from an electric controller and the first hub lock actuator is driven in response to a mechanical input.

4. The mortise lock of claim 3, wherein the mechanical input is a movement of an operator input accessible from an exterior of the mortise lock.

5. The mortise lock of claim 3, wherein the electrical input drives a motor to actuate the second hub lock actuator.

6. The mortise lock of claim 1, wherein the hub lock comprises a base member;

a first locking toggle supported by the base member and including a first engagement feature which is positionable to engage an engagement feature of the first latch hub; and a second locking toggle supported by the base member and including a first engagement feature which is positionable to engage an engagement feature of the second latch hub;

wherein the first locking toggle is positionable relative to the base member in a first position and a second position, the first position of the first locking toggle relative to the base member results in the first engagement feature of the first locking toggle engaging the engagement feature of the first latch hub when the hub lock is in the second position and the second position of the first locking toggle relative to the base member results in the engagement feature of the first locking toggle remaining disengaged from the engagement feature of the first latch hub when the hub lock is in the second position; and wherein the second locking toggle is positionable relative to the base member in a first position and a second position, the first position of the second locking toggle relative to the base member results in the first engagement feature of the second locking toggle engaging the engagement feature of the second latch hub when the hub lock is in the second position and the second position of the second locking toggle relative to the base member results in the engagement feature of the second locking toggle remaining disengaged from the engagement feature of the second latch hub when the hub lock is in the second position.

7. The mortise lock of claim 1, wherein the first hub lock actuator includes an engagement feature which interacts with a first engagement feature of the hub lock to move the hub lock from the first position to the second position and the second hub lock actuator includes an engagement feature which interacts with a second engagement feature of the hub lock to move the hub lock from the first position to the second position.

8. The mortise lock of claim 1, wherein the first hub lock actuator is disengaged from the hub lock when the hub lock is moved to the second position by the second hub lock actuator.

9. The mortise lock of claim 1, wherein the second hub lock actuator is engaged with the hub lock when the hub lock is moved to the second position by the first hub lock actuator.

10. The mortise lock of claim 1, wherein the first hub lock actuator includes a cam and a locking lever operatively coupled to the cam, the cam having a first cam position wherein the locking lever is positioned to permit the hub lock to be in the first position of the hub lock and a second cam position wherein the locking lever is positioned to hold the hub lock in the second position of the hub lock.

11. The mortise lock of claim 1, wherein the second hub lock actuator includes a motor, a gear assembly moveable by the motor, and a coupler driven by the gear assembly, the coupler having a first position wherein the hub lock is permitted to be in the first position of the hub lock and the coupler having a second position wherein the hub lock is held in the second position of the hub lock.

12. The mortise lock of claim 11, wherein the gear assembly includes a worm gear rotatably mounted to the motor and a sector gear driven by the worm gear.

13. A mortise lock, comprising:

a mortise housing having a bottom and a top;

a latch bolt supported by the mortise housing and moveable between an extended position and a retracted position, the latch bolt having a bottom surface and a top surface;

a latch hub supported by the mortise housing and operatively coupled to the latch bolt, the latch hub being rotatable relative to the mortise housing about an axis, the axis being positioned above the bottom of the mortise housing and below the bottom surface of the latch bolt;

a lever supported by the mortise housing, the lever being rotatable to cause the latch bolt to move to the retracted position in response to a rotation of the latch hub about the axis; and a plurality of hub lock actuators supported by the mortise housing, each of the plurality of hub lock actuators are actuatable to selectively cause coupling of the respective hub lock actuator with a common engagement feature of the latch hub to prevent the latch hub from being positionable to move the latch bolt to the retracted position.

14. The mortise lock of claim 13, wherein a first hub lock actuator of the plurality of hub lock actuators is driven in response to an electrical input from an electric controller and a second hub lock actuator of the plurality of hub lock actuators is driven in response to a mechanical input.

15. The mortise lock of claim 14, wherein the first hub lock actuator of the plurality of hub lock actuators is actuatable independent of the second hub lock actuator of the plurality of hub lock actuators.

16. The mortise lock of claim 14, wherein when the common engagement feature of the latch hub is engaged due to an actuation of one of the first hub lock actuator of the plurality of hub lock actuators and the second hub lock actuator of the plurality of hub lock actuators, a subsequent actuation of the other of the first hub lock actuator of the plurality of hub lock actuators and the second hub lock actuator of the plurality of hub lock actuators is unable to disengage the common engagement feature of the latch hub to permit retraction of the latch bolt due to a rotation of the latch hub.

17. The mortise lock of claim 14, wherein each of the first hub lock actuator of the plurality of hub lock actuators and the second hub lock actuator of the plurality of hub lock actuators are operatively engageable with a common hub lock, the hub lock being positionable by either of the first hub lock actuator of the plurality of hub lock actuators and the second hub lock actuator of the plurality of hub lock actuators to engage the common engagement feature of the latch hub.

18. The mortise lock of claim 13, wherein each of a first hub lock actuator of the plurality of hub lock actuators and a second hub lock actuator of the plurality of hub lock actuators are operatively engageable with a hub lock, wherein once the hub lock is engaged with the latch hub due to an actuation of one of the first hub lock actuator and the second hub lock actuator, a subsequent actuation of the other of the first hub lock actuator and the second hub lock actuator is unable to disengage the hub lock from the latch hub.

* * * * *